US006208090B1

(12) United States Patent
Skilskyj et al.

(10) Patent No.: US 6,208,090 B1
(45) Date of Patent: Mar. 27, 2001

(54) REDUCED VOLTAGE AND TIME DELAY TO ELIMINATE FILAMENT HOT SHOCK

(75) Inventors: Ludwig Skilskyj, Concord; Laszlo V. Lieszkovszky, Mayfield; Leonard E. Hoegler, Solon; Edward J. Collins, Painesville, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/565,252

(22) Filed: May 5, 2000

(51) Int. Cl.[7] ..... H05B 37/02

(52) U.S. Cl. ..... 315/360; 315/71; 315/72; 313/578

(58) Field of Search ..... 315/360, 71, 72, 315/127, 200 R; 313/578, 579, 25, 318

(56) References Cited

U.S. PATENT DOCUMENTS 4,473,776 * 9/1984 Peters ..... 315/74
4,480,212 * 10/1984 Monahan et al. ..... 315/71
4,547,704 * 10/1985 Brinn et al. ..... 315/71
4,743,803 * 5/1988 Lanese et al. ..... 313/579

* cited by examiner

*Primary Examiner*—Haissa Philogene
(74) *Attorney, Agent, or Firm*—Fay, Sharpe, Fagan, Minnich & McKee, LLP

(57) ABSTRACT

A method to eliminate filament hot shock in lamp filaments, particularly in compact filament light sources such as high efficiency infrared reflective coated halogen lamps, during installation or during energization comprising a voltage reduction circuit that reduces the voltage applied to the lamp filaments for a predetermined period of time and a timing circuit that is activated each time the lamp is energized and controls the predetermined period of time during which the voltage reduction circuit reduces voltage applied to the lamp filaments. Optionally, a one time latch circuit may be included that enables the timing circuit upon energization and disables it after the voltage reduction circuit has operated continuously for the predetermined period of time, and forever thereafter.

18 Claims, 4 Drawing Sheets

REDUCED VOLTAGE AND TIME DELAY TO ELIMINATE FILAMENT HOT SHOCK

FIELD OF THE INVENTION

The present invention relates to a lamp having compact filaments and, more particularly, to the hot shock failure mode known to occur in this type of lamp.

BACKGROUND OF THE INVENTION

With the introduction of high efficiency infrared reflective coated halogen lamps, the filament size has become more compact and, therefore, more susceptible to shock. Hot shock is a failure mode known to lamp makers where two or more primary or secondary turns of an incandescent filament touch, adhere to one another, and short out a portion of the active filament, resulting in an early burnout of the filament. Over the years, data has been collected from actual customer applications that indicate hot shock damage in this type of lamp occurs during the initial installation with the power on. As customers with hundreds of lamps complained of early hot shock failures, new lamps of the same design were installed with the power off, and the hot shock failures were greatly reduced. In a very few cases, the problem persisted due to vibration caused by construction in the area.

Presently, the primary solution to the hot shock problem requires that the filament be designed with increased spacing between turns of the filament and/or the addition of higher levels of nitrogen. In either case, the lamp efficacy is reduced, and in many cases, the only solution is to install the lamps with the power turned off.

SUMMARY OF THE INVENTION

Accordingly, the present invention provides an apparatus and a method to eliminate filament hot shock in lamp filaments, particularly in compact filament light sources such as high efficiency infrared reflective coated halogen lamps, during installation or during energization wherein the method comprises a voltage reduction circuit that reduces the voltage applied to the lamp filaments for a predetermined period of time and a timing circuit that is activated each time the lamp is energized and controls the predetermined period of time during which the voltage reduction circuit reduces voltage applied to the lamp filaments. As part of the apparatus, a one time latch circuit is optionally included to enable the timing circuit upon energization and disable it once the voltage reduction circuit has operated continuously for the predetermined period of time, and forever thereafter.

Use of the invention means that it is no longer necessary to increase is the spacing between turns of the filament or to add higher levels of nitrogen to the lamp tube to minimize hot shock. Both of the aforementioned remedies reduce the efficacy of the lamp, a drawback that is eliminated by the present invention.

DETAILED DESCRIPTION OF THE INVENTION

Figure 1:
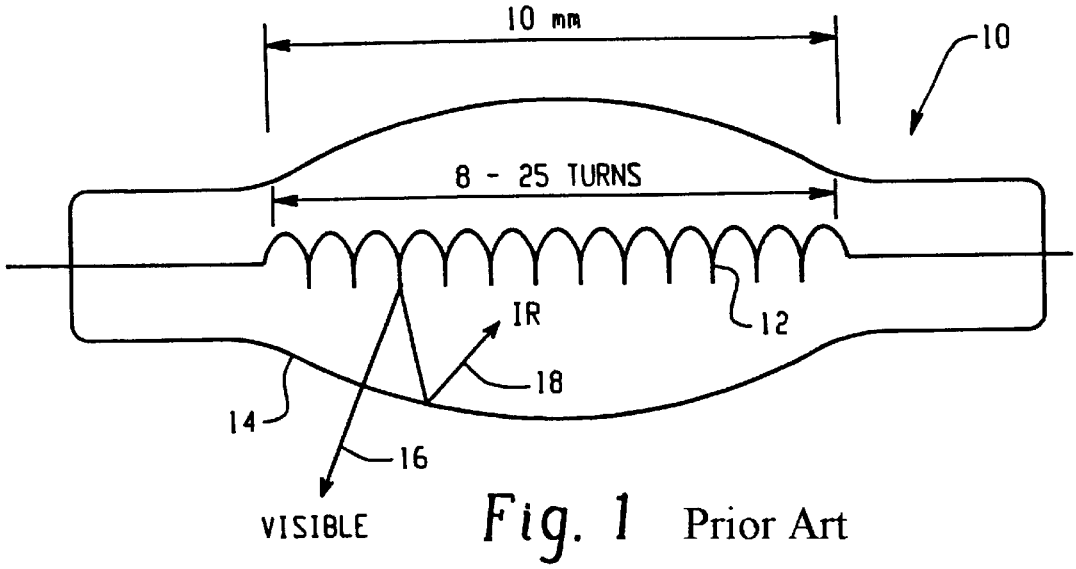
Fig. 1 Prior Art
FIG. 1 is a drawing of a typical high efficiency infrared reflective coated halogen lamp filament tube.

FIG. 1 shows a typical high efficiency infrared reflective coated halogen lamp filament tube 10 to which the invention may be suitably applied. In one embodiment, a filament tube of this type will typically have a filament 12 approximately 10 millimeters in length consisting of 8 to 25 secondary turns. The wall 14 of the filament tube 10 will typically be coated so that the wall is translucent to electromagnetic radiation 16 in the visible spectrum, however, it will reflect radiation 18 in the infrared region. The reflected infrared radiation 18 helps heat the filament 12, thereby reducing power requirements for the lamp. The close spacing between turns of the filament will occasionally allow neighboring turns of the filament to contact each other if the tube is undergoing vibration such as it would encounter during installation into an energized socket. Even a momentary contact at normal operating temperatures of the filament 12 will allow adjacent turns of the filament 12 to weld permanently together, effectively shorting one or more turns of the filament, resulting in higher current flow, larger power consumption, overheating of the filament 12 and consequent early failure of the filament 12. This type of failure is referred to as a hot shock failure mode known to lamp makers where two or more primary or secondary turns of an incandescent filament 12 touch, adhere to one another, and short out the active filament, resulting in an early burnout of the filament 12. It is of course to be understood that the present invention may also be implemented in other sizes and types of lamps which may suffer from hot shock failure due to the closeness of the filament turns.

Figure 2:
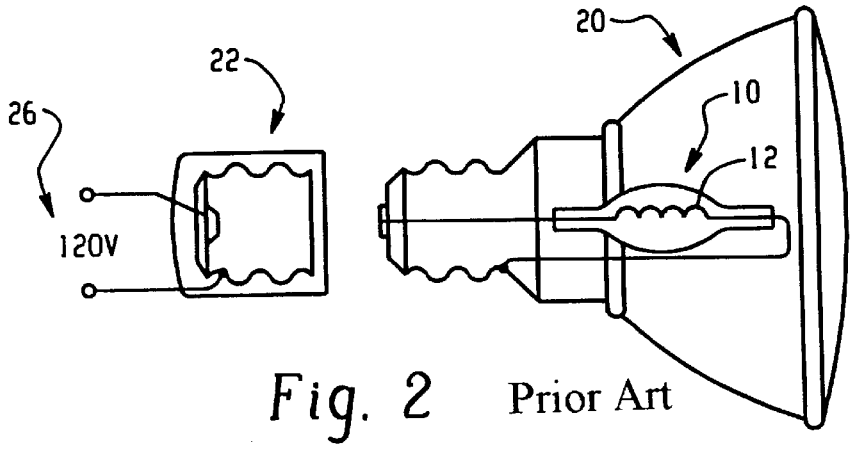
Fig. 2 Prior Art
FIG. 2 is a drawing of a typical high efficiency infrared reflective coated halogen lamp installation.
Figure 3:
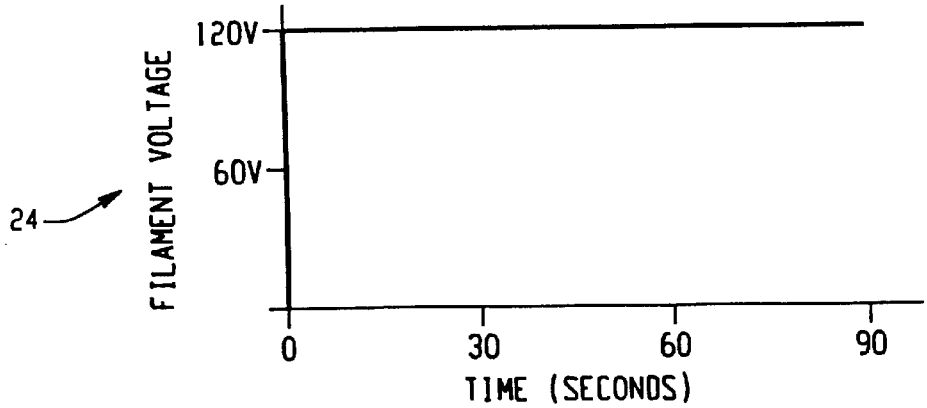
Fig. 3 Prior Art
FIG. 3 is a filament voltage graph for the lamp.

FIG. 2 shows a high efficiency infrared reflective coated halogen lamp 20 that utilizes the filament tube of FIG. 1 during installation into an energized socket 22. As shown in FIG. 3, a voltage 24 applied to the filament 12 substantially instantaneously goes to full line voltage 26 upon insertion of the lamp 20 into the socket 22. Vibration as lamp 20 is tightened, after the filament 12 has been energized, can cause adjacent turns of the filament 12 to touch, resulting in the aforementioned hot shock failure mode.

Figure 4:
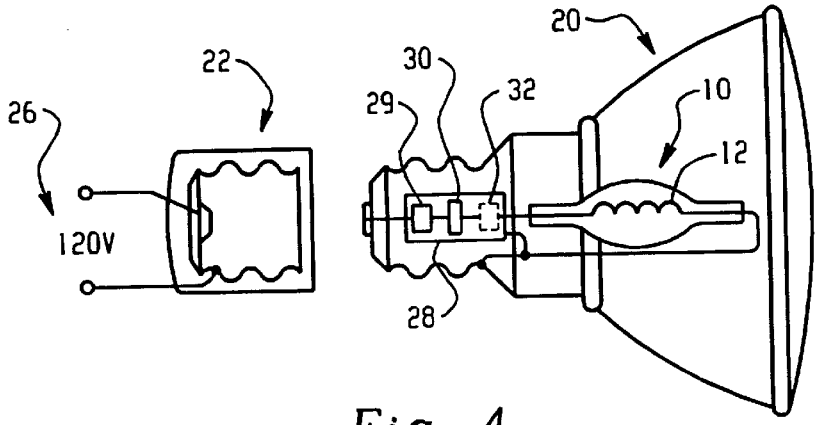
FIG. 4 is a drawing, partially in block form, of an improved high efficiency infrared reflective coated halogen lamp installation.

Referring now to FIG. 4, with continuing reference to FIGS. 2 and 3, a first embodiment of the invention is illustrated. The elements of FIG. 4 are similar to those of FIG. 2, with the exception being the addition of a delay circuit 28 to the lamp 20. With the addition of the delay circuit 28, the filament voltage 24 no longer goes substantially instantaneously to full line voltage 26.

Figure 5:
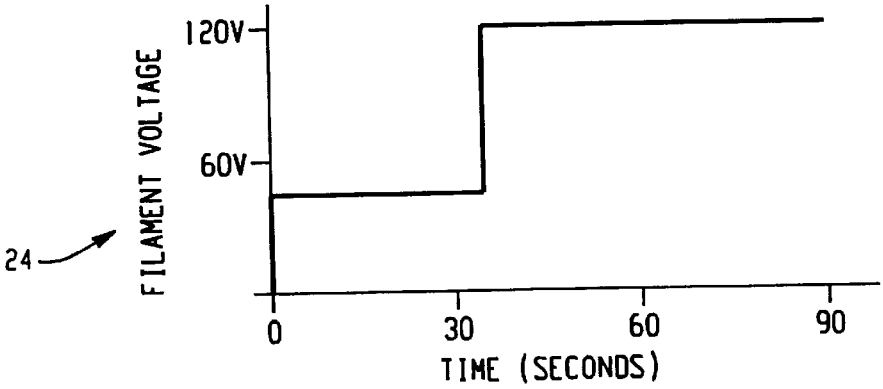
FIG. 5 is a filament voltage graph for the lamp of FIG. 4.

Instead, the filament voltage 24 is reduced to approximately 40 volts for the first 30 seconds as shown in FIG. 5, and only then is allowed to approach full line voltage. The delay circuit includes a voltage reduction circuit 29 that reduces the voltage applied to the lamp filaments for a predetermined period of time and a timing circuit 30 that is activated each time the lamp is energized. The timing circuit 30 controls the predetermined period of time during which the voltage reduction circuit 29 reduces voltage applied to the lamp filament 12.

To determine an appropriate optimal voltage reduction of the delay circuit 28, twenty (20) lamps of the same design (60PAR/HIR 120V) were tested, a sample of 5 at 120, 80, 60 and 40 volts. Each lamp was lit by a constant current supply at those voltages. The lamps were then swung on a pendulum arm against a stop. The distance was increased until a voltage drop was measured indicating hot shock. The results showed that the average distance required to hot shock increased with a reduction in voltage. At 40 volts, the distance required to hot shock the lamp deformed the filament and caused instant burnout. Forty (40) volts was consequently chosen as the optimal voltage reduction amount for the delay circuit 28 for the described lamps (12). At 40 volts, the filament 12 is hot enough to provide enough illumination to confirm lamp operation for the installer, but not hot enough to allow hot shock failure mode. A lower voltage is insufficient to adequately illuminate the lamp, however, reduced voltages up to 80 volts are also acceptable.

Delay circuit 28 described above results in a short delay before full illumination of the lamp 20. This delay is not a significant drawback since this type of lamp is typically used in a commercial environment where other lamps are fully illuminated at the time. For example, a retail store may have one burned out bulb, out of many, that requires replacing, and this is usually done while the lighting circuit remains energized. If this delay is undesirable, the delay circuit 28 can optionally further include a one time latching circuit 32 that permanently disables the timing circuit after the voltage reduction circuit has operated, at least once, continuously for the full predetermined time period. In this way, the lamp 20 will have reduced voltage applied to the filament 12 during initial installation but will substantially instantaneously apply full line voltage 26 to the filament 12 each time the lamp is turned on thereafter.

Figure 6:
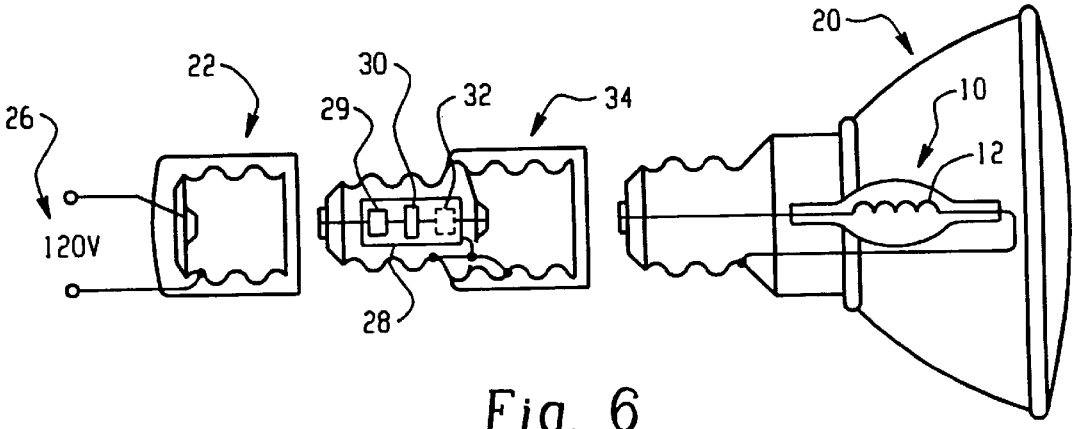
FIG. 6 is a drawing of a typical high efficiency infrared reflective coated halogen lamp installation, in a second embodiment of the invention.

Referring now to FIG. 6, a second embodiment of the invention is illustrated. In this embodiment, the delay circuit 28 is incorporated into an adaptor 34. The delay circuit 28 incorporated into the adaptor 34 includes the same voltage reduction circuit 29, timing circuit 30 and optional one time latching circuit 32 as previously described. The adaptor 34 is installed in the same socket 22 as the standard lamp 20 would have been installed without the invention. Operation of the second embodiment is, otherwise similar to that of the first embodiment.

Figure 7:
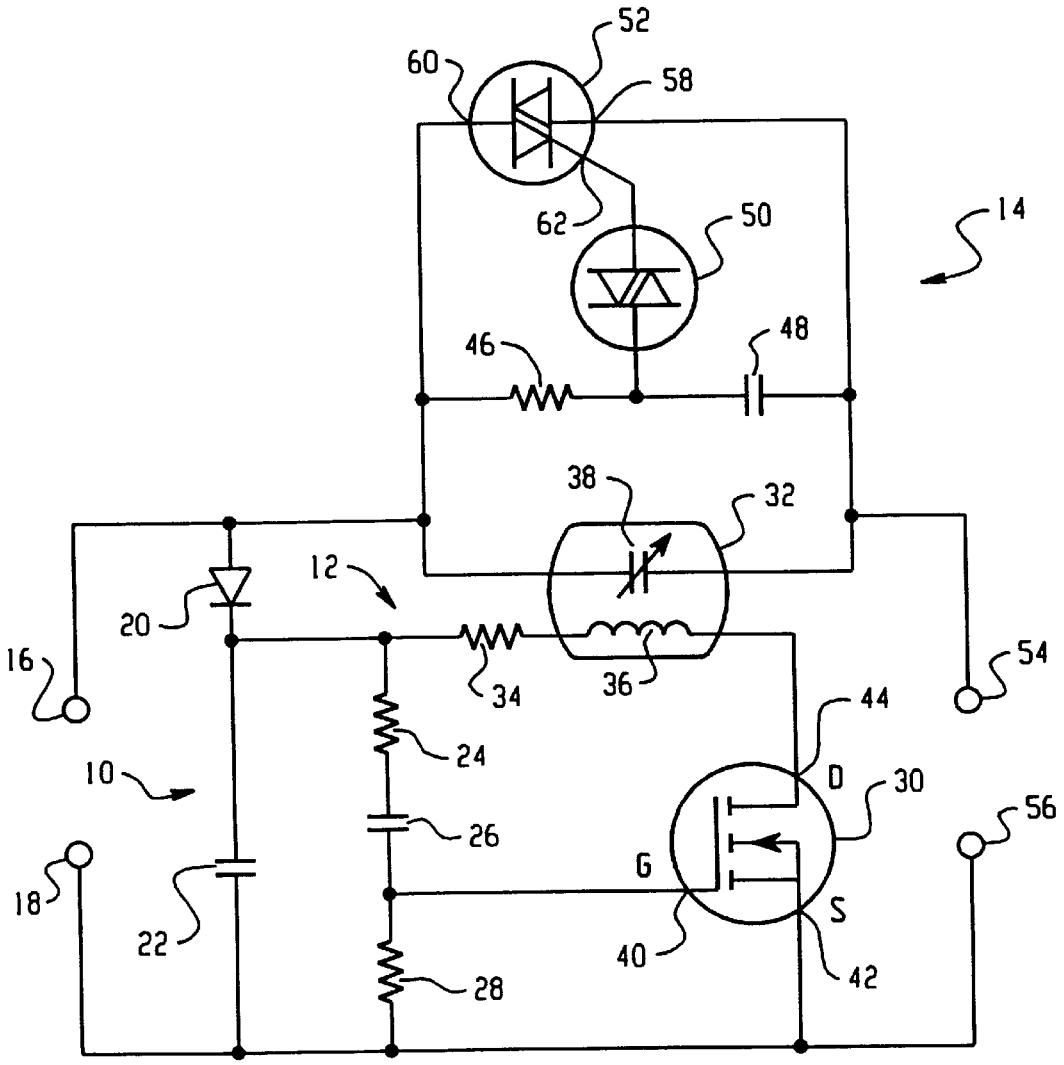
FIG. 7 is one embodiment of a delay circuit of the present invention.

Referring now to FIG. 7, an exemplary embodiment of a delay circuit suitable for adaptation to the present invention is illustrated. The circuit comprises a rectifier circuit 10, a timer circuit 12 and a voltage reduction circuit 14 connected in parallel with timer circuit 12. The rectifier circuit 10 is connected between input terminals 16 and 18 and includes a rectifier diode 20 whose anode is connected to input terminal 16 and whose cathode is connected to filter capacitor 22 with the remaining lead of capacitor 22 being connected to input terminal 18.

The purpose of the rectifier circuit 10 is to provide an approximately DC voltage at the junction of rectifier diode 20 and filter capacitor 22 for timing circuit 12.

Timing circuit 12 includes a first timing resistor 24, a timing capacitor 26 and a second timing resistor 28 serially connected in the order listed between the junction of rectifier diode 20 with filter capacitor 22 and input terminal 18. Timing circuit 12 further includes switch 30, relay 32 and current limiting resistor 34, with relay 32 comprising energizing coil 36 and normally closed contacts 38. In this embodiment, switch 30 comprises a MOSFET transistor including gate 40, source 42 and drain 44 with gate 40 connected to the junction of timing capacitor 26 and second timing resistor 28, and with source 42 connected to input terminal 18. Current limiting resistor 34 is first connected to the junction of rectifier diode 20 and filter capacitor 22 with the remaining lead connected to energizing coil 36 whose remaining lead is connected to drain 44 of switch 30. Voltage reduction circuit 14 comprises resistor 46, capacitor 48, diac 50 and thyristor 52. Resistor 46 and capacitor 48 are serially connected in the order listed between input terminal 16 and output terminal 54. Relay contacts 38 are also connected between input terminal 16 and output terminal 54. Thyristor 52 includes main terminal MT1 (58), main terminal MT2 (60) and gate terminal 62 with terminal 58 connected to output terminal 54 and terminal 60 connected to input terminal 16. Diac 50 is connected is between gate terminal 62 and the junction of resistor 46 with capacitor 48.

To briefly describe the operation of the circuit of FIG. 7, when the circuit is initially energized, capacitor 22 quickly charges to nearly 170 volts, assuming an input voltage between terminals 16 and 18 of 120 volts RMS. Current now flows through first timing resistor 24, timing capacitor 26 and second timing resistor 28, charging timing capacitor 26. This charging current creates a voltage drop sufficiently large across second timing resistor 28 to turn switch 30 on which, in turn, causes current to flow through energizing coil 36, opening contacts 38. With contacts 38 open, current flowing between input terminal 16 and output terminal 54 must now pass through voltage reducing circuit 14. Voltage reducing circuit 14 is a typical light dimming circuit wherein thyristor 52 does not turn on until sufficient charge has accumulated on capacitor 48 to overcome the breakdown voltage of diac 50. Diac 50, resistor 46 and capacitor 48 are selected such that the RMS output voltage is reduced to the desired value, 40 volts RMS in this exemplary case. Timing resistors 24 and 28, and timing capacitor 26 are selected such that the voltage drop across timing resistor 28 is insufficient to keep switch 30 turned on after approximately 30 seconds at which time current stops flowing through energizing coil 36 allowing contacts 38 to close and, in turn, allowing the input voltage on terminal 16 to pass unrestricted to output terminal 54. Timing resistors 24 and 28 are further selected such that the voltage rating of gate 40 is not exceeded. Input terminal 18 and output terminal 56 are interconnected and are intended to be at ground potential. Relay 32 has normally closed contacts 38 so that, in the event of a failure in rectifier circuit 10 or timing circuit 12, full input voltage at terminal 16 will be supplied to output terminal 54. Capacitor 22 can be sized sufficiently large to provide a short term memory so that momentary interruptions of the input voltage will not incur another time delay before full input voltage is reapplied to output terminals 54 and 56.

Figure 8:
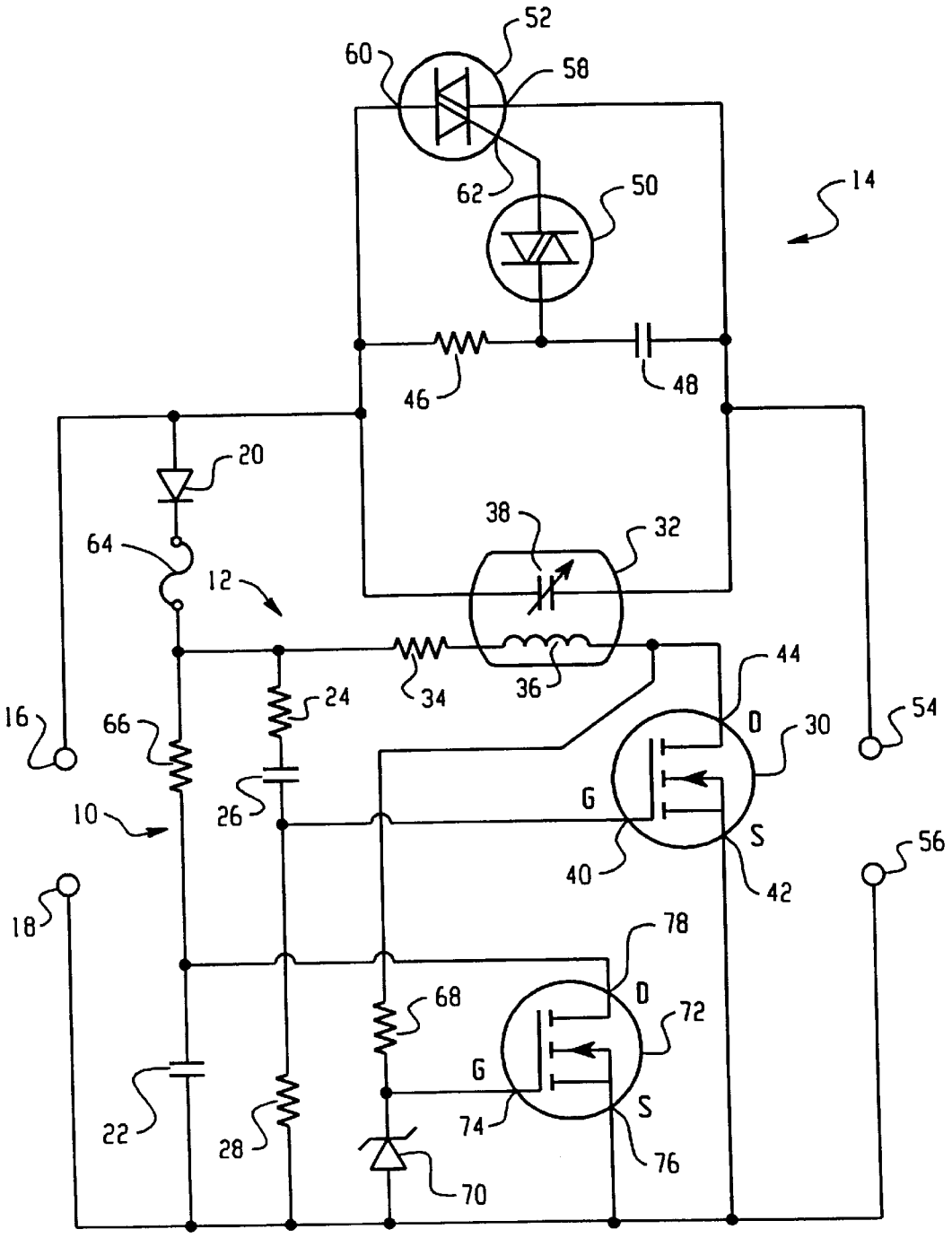
FIG. 8 is a second embodiment of the delay circuit of the present invention with a one-time latch.

FIG. 8 illustrates an exemplary embodiment similar to FIG. 7 with the addition of components to disable the timing circuit and voltage reduction circuit after completion of one full voltage reduction cycle. The circuit in FIG. 8 is identical to that in FIG. 7 with the following exceptions. Time delay fuse 64 and serially connected resistor 66 are inserted between the cathode of rectifier diode 20 and capacitor 22. The junction of resistors 24 and 34 is reconnected to the junction of fuse 64 and resistor 66. Resistor 68 and zener diode 70 are serially connected in the order listed between drain 44 and input ground terminal 18. Switch 72 is inserted with gate 74 connected to the junction of resistor 68 with zener diode 70, source 76 connected to input terminal 18, and drain 78 connected to the junction of capacitor 22 with resistor 66. The circuit of FIG. 8 operates essentially identically to that of FIG. 7, however, when switch 30 opens after approximately 30 seconds, switch 72 closes, drawing enough current to burn out fuse 64 thereby disabling the timing circuit. Future energizations of this circuit will not incur a time delay.

Exemplary component values for the circuits of FIGS. 7 and 8 are as follows:

| | |
|---|---|
| Rectifier diode 20 | 1 A, 200 V |
| Filter capacitor 22 | 0.1 $\mu$F |
| First timing resistor 24 | 220 megΩ |
| Timing capacitor 26 | 0.06 $\mu$F |
| Second timing resistor 28 | 22 megΩ |
| Switch 30 | MOSFET, 200 V, $V_G$ = 2 V |
| Relay 32 | 1 A, $V_{COIL}$ = 24 V at 5 mA |
| Resistor 34 | 20 kΩ |
| Resistor 46 | 330 kΩ |
| Capacitor 48 | 0.062 $\mu$F |
| Diac 50 | 32 V |
| Triac 52 | 1 A, 200 V |
| Fuse 64 | 0.1 A Time delay |
| Resistor 66 | 220Ω |
| Resistor 68 | 100 kΩ |
| Zener diode 70 | 12 V |
| Switch 72 | MOSFET, 200 V, $V_G$ = 2 V |

There are many other timing and voltage reduction circuits known in the art that are suitable for use in the present invention. Accordingly, the present invention envisions the inclusion of any of these circuits in the embodiments according to FIGS. 7 and 8.

Prior art solutions to the hot shock failure mode required the filament to be designed with increased spacing between filament turns and/or the addition of higher levels of nitrogen. In both cases, the lamp efficacy was reduced. In many cases the only solution was to install lamps with the power off. The methods disclosed above avoid the aforementioned drawbacks incurred by increasing the spacing between filament turns.

While the invention has been described with respect to specific embodiments by way of illustration, many modifications and changes will occur to those skilled in the art. It is therefore to be understood that the appended claims are intended to cover all such modifications and changes as fall within the true spirit and scope of the invention.

What is claimed is:

1. An apparatus which eliminates filament hot shock in lamp filaments during lamp installation, the apparatus comprising:

a voltage reduction circuit that reduces the voltage applied to the lamp filaments for a predetermined period of time; and, a timing circuit that is activated each time the lamp is energized and controls the predetermined period of time during which the voltage reduction circuit reduces voltage applied to the lamp filaments.

2. The apparatus of claim 1 wherein the voltage reduction circuit and the timing circuit are installed in the lamp.

3. The apparatus of claim 1 wherein the voltage reduction circuit and the timing circuit are installed in an adaptor to be installed between the lamp's base and a socket into which the lamp is being installed.

4. The apparatus of claim 1 wherein the lamp consists of a high efficiency infrared reflected type lamp.

5. The apparatus of claim 1 wherein the voltage reduction circuit reduces the voltage applied to the lamp filaments to approximately 40 to 80 volts.

6. The apparatus of claim 1 wherein the timing circuit activates the voltage reduction circuit for approximately 30 seconds.

7. The apparatus of claim 1 wherein the lamp filaments are approximately 10 millimeters in length.

8. The apparatus of claim 1 wherein the lamp filaments consist of 8 to 25 secondary turns.

9. An apparatus which eliminates filament hot shock in lamp filaments during lamp installation, the apparatus comprising:

a lamp receptacle connected to a power source;

a filament type lamp;

a voltage reduction circuit that reduces the voltage applied to the lamp filaments for a predetermined period of time; and, a timing circuit that is activated each time the lamp is energized and controls the predetermined period of time during which the voltage reduction circuit reduces voltage applied to the lamp filaments.

10. A method to eliminate filament hot shock in lamp filaments during power-on installation or during initial energization comprising:

reducing the voltage applied to the lamp filaments for a predetermined period of time by use of a voltage reduction circuit; and, controlling a predetermined period of time, by a timing circuit, during which the voltage reduction circuit reduces voltage applied to the lamp filaments.

11. The method of claim 10 further including the steps of:

enabling, by a one time latch circuit, the timing circuit upon energization; and, disabling the timing circuit after the voltage reduction circuit has operated continuously for the predetermined period of time, and forever thereafter.

12. The method of claim 10 wherein the voltage reduction circuit, the timing circuit and the latch circuit are installed in the lamp.

13. The method of claim 10 wherein the voltage reduction circuit, the timing circuit and the latch circuit are installed in an adaptor installed between the lamp's base and a socket into which the lamp is being installed.

14. The method of claim 10 wherein the lamp consists of a high efficiency infrared reflected type lamp.

15. The method of claim 10 wherein the voltage reduction circuit reduces the voltage applied to the lamp filaments to approximately 40 to 80 volts.

16. The method of claim 10 wherein the timing circuit activates the voltage reduction circuit for approximately 30 seconds.

17. The method of claim 10 wherein the lamp filaments are approximately 10 millimeters in length.

18. The method of claim 10 wherein the lamp filaments consist of 8 to 25 secondary turns.

* * * * *